US008622878B2

(12) United States Patent
Abelbeck

(10) Patent No.: US 8,622,878 B2
(45) Date of Patent: Jan. 7, 2014

(54) FUNCTIONAL EXERCISE DEVICE

(75) Inventor: Kevin Abelbeck, Fort Collins, CO (US)

(73) Assignee: Abelbeck Partners, Ltd, Fort Collins, CO (US)

( * ) Notice: Subject to any disclaimer, the term of this patent is extended or adjusted under 35 U.S.C. 154(b) by 321 days.

(21) Appl. No.: 12/930,996

(22) Filed: Jan. 22, 2011

(65) Prior Publication Data

US 2012/0149535 A1 Jun. 14, 2012

Related U.S. Application Data

(60) Provisional application No. 61/459,330, filed on Dec. 10, 2010.

(51) Int. Cl.
*A63B 21/06* (2006.01)
*A63B 21/00* (2006.01)

(52) U.S. Cl.
USPC ..... 482/93

(58) Field of Classification Search
USPC ..... 482/92–93, 100, 132–139, 148; 473/441, 422; 434/247, 251
See application file for complete search history.

(56) References Cited

U.S. PATENT DOCUMENTS 4,018,442 A * 4/1977 Galler ..... 482/106
5,487,712 A * 1/1996 Kann ..... 482/97
5,679,105 A * 10/1997 Vittone et al. ..... 482/93
5,681,249 A * 10/1997 Endelman ..... 482/142
5,735,779 A * 4/1998 Lay ..... 482/93
6,004,245 A * 12/1999 Boos ..... 482/93
6,010,437 A 1/2000 Jones
6,203,474 B1 3/2001 Jones
6,679,815 B2 * 1/2004 Vittone et al. ..... 482/78
6,926,650 B2 * 8/2005 Endelman et al. ..... 482/121
7,097,601 B1 * 8/2006 Ronnow ..... 482/106
7,803,095 B1 * 9/2010 LaGree ..... 482/140
7,972,224 B2 * 7/2011 Gilman ..... 473/455
2002/0137603 A1 * 9/2002 Vittone et al. ..... 482/93
2005/0124468 A1 * 6/2005 Wong ..... 482/52
2009/0143201 A1 * 6/2009 Uygan ..... 482/93
2011/0177891 A1 * 7/2011 Gilman ..... 473/441

OTHER PUBLICATIONS

Keogh, J.W.L., et al. A Brief Description of the Biomechanics and Physiology of a Strongman Event: The Rire Flip, JSCR, 2010, 1223-1228, 24(5), Williams & Wilkins.
McGill, S.M., et al. Comparison of Different Strongman Events: Trunk Muscle Activation and Lumbar Spine Motion, Load and Stiffness, JSCR, 2009, 1148-1161, 23(4), Williams & Wi.
Bullock, J.B. and Aipa, D.M.M. Coaching Considerations for the Tire Flip, Strength and Conditioning Journal, 2010, 75-78, 32(5), Williams & Wilkins.

* cited by examiner

*Primary Examiner* — Loan Thanh
*Assistant Examiner* — Shila Jalalzadeh Abyane

(57) ABSTRACT

An exercise device is provided, having a frame with a first end opposite to a second end and a top portion opposite to a bottom portion, thereby defining four opposing corners. One or more pins may be coupled to the frame between the first end and the second end, the pins adapted to receive weight plates. A bumper may be coupled to each of the four opposing corners. The bumper may be a substantially longitudinal hollow member which may include a plurality of treads on a side opposite to that coupled to the frame. The device may then be supported by two of the bumpers and flipped over to be supported by the other two bumpers. The lifting and flipping of the device provides an exercise which employs many of the major muscles groups of the body. Weight plates may be added or removed to accommodate different users.

22 Claims, 9 Drawing Sheets

FUNCTIONAL EXERCISE DEVICE

CROSS-REFERENCE TO RELATED APPLICATION DATA

Priority is claimed under 35 U.S.C. §119(e) to U.S. Provisional Application No. 61/459,330, filed on Dec. 10, 2010, which is incorporated by reference herein.

FIELD OF THE INVENTION

The present invention generally relates to exercise devices and, more particularly, to exercise devices which enable simulation of a functional activity.

BACKGROUND OF THE INVENTION

Exercise has been shown to have significant benefits to the general population as well as athletes of all types. The term Functional Training has started to become more popular recently. Functional Training may be referred to as "purposeful training", as it is not exercise for the sake of exercise or exercise to build a bigger biceps muscle. Functional training is performing exercises to simulate an activity or motion used on the playing field or in life.

Endurance athletes have traditionally trained functionally. If they are runners, they ran. If they are cyclists, they rode. Many athletes fall under the umbrella of strength and power. Throwing a discus, jumping and sprinting are better equated to power development than to strength as an optimal result is the work done over the shortest amount of time. A football lineman exploding off the line to meet his opponent relies on his power for optimal performance. Holding his position against the forces of the opponent uses his strength. An athlete's strength is important when it comes to slow movements under a great deal of resistance. When power is important is when the movement is fast. It is easy to see that both strength and power are important in many physical events.

Functional training in strength and power has only started to gain some popularity. Functional strength training in a gym or weight room has been very limited due to the lack of equipment available to simulate functional events. A barbell squat is very good for developing strength in the lower body extensor muscles of the user, but it is only functional if that athlete competes by lifting a bar placed on his back. For a powerlifter, it is functional, as this type of lifting is his how that athlete competes. For the football lineman, a squat may be a good supplementary exercise to build strength, but the conditions on the field are far from replicated in a squat rack. On the field, the athlete will move and step. Under load they may be momentarily balanced on one foot. Load may be applied to the hands and supported by the feet on the ground, thus the arms to the torso to the legs are all under stress. Little, if any, gym based exercise equipment is currently available to prepare the athlete for these conditions.

One item currently used by strength and conditioning professionals is old truck tires. The tires are laid flat on the ground or turf. The user approaches the tire, puts their hands under the lower edge of the tire and then lifts the tire to vertical and pushes it over. Though this presents a very functional movement, the tire has several limitations as a form of resistance. First, the weight cannot be changed to accommodate different users or progressive resistance as an athlete increases in strength and power. The diameter and thickness (height) are different for many tires and are therefore inconsistent from one program to the next. New tires can cost tens of thousands of dollars and are therefore, not practical. The usual process is to buy tires before they are recycled. This presents a "this is what is available, take it or leave it" situation for the strength coach and his athletes. In addition, a 700 pound tire cannot be broken down to a 200 pound frame, that may be more easily moved and stored, and 500 pounds of weight plates that can be used elsewhere. The tire was designed to be a tire and not a piece of exercise equipment, so there are other natural limitations such as the lack of proper handles. Also, worn tires often have exposed steel belts that can rub against the athlete's arms, resulting in injury to the athlete and limiting the weight they can lift due to an inability to hold on to the tire.

It should, therefore, be appreciated that there is a need for a functional training device that allows for altering resistance for different users, as well as enables progressive training as the user increases in strength and power development. The present invention fulfills this need and others.

SUMMARY OF THE INVENTION

The present invention provides a frame including a first end opposite to a second end and a top portion opposite to a bottom portion, thereby defining four opposing corners. A pin may be coupled to the frame between the first end and the second end. The pin may be adapted to receive one or more weight plates. A bumper may be coupled to each of the four opposing corners. The bumper may be a substantially longitudinal hollow member which may include a plurality of treads on a side opposite to that coupled to the frame. The device may be supported by two of the bumpers and flipped over to be supported by the other two bumpers.

The frame may be substantially symmetrical about three orthogonal planes, the planes intersecting at a geometric center of the frame. The pin may be one or more pins positioned substantially midway between the top portion and the bottom portion of the frame. The exercise device may include a pair of pins, each pin may be positioned substantially midway between the top portion and the bottom portion of the frame and each pin positioned on opposing sides of a midpoint between the first end and the second end of the frame.

The exercise device may include a chest support coupled to the frame and positioned adjacent to each bumper. The chest support may be coupled to a bumper. The chest support may be coupled to the frame such that a portion of the chest support has a greater distance from a geometric center of the frame compared to the distance from any portion of the frame to the geometric center of the frame.

Handles may also be coupled to the frame and may be adjacent to the first end and the second end of the frame. The handles may be positioned such that a portion of the chest support may have a greater distance from a geometric center of the frame compared to the distance of the handle to the geometric center of the frame.

An exemplary method for exercise using a device as disclosed, the steps including a user grasping the frame and lifting the device on one end with the other end of the device on the ground. The user may act to extend their body to flip the device over and away from the user. The user may change the weight plates on the pin, and repeat the lifting step. Additional steps of lifting the device may include the first pull, lifting one end of the device past the knee of the user, a second pull, lifting one end of the device from the above the knee toward the chest, a transition, resetting the arms from a pull grip to a push grip and a push, extending the arms and legs to cause the device to be flipped over away from the user.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment (s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
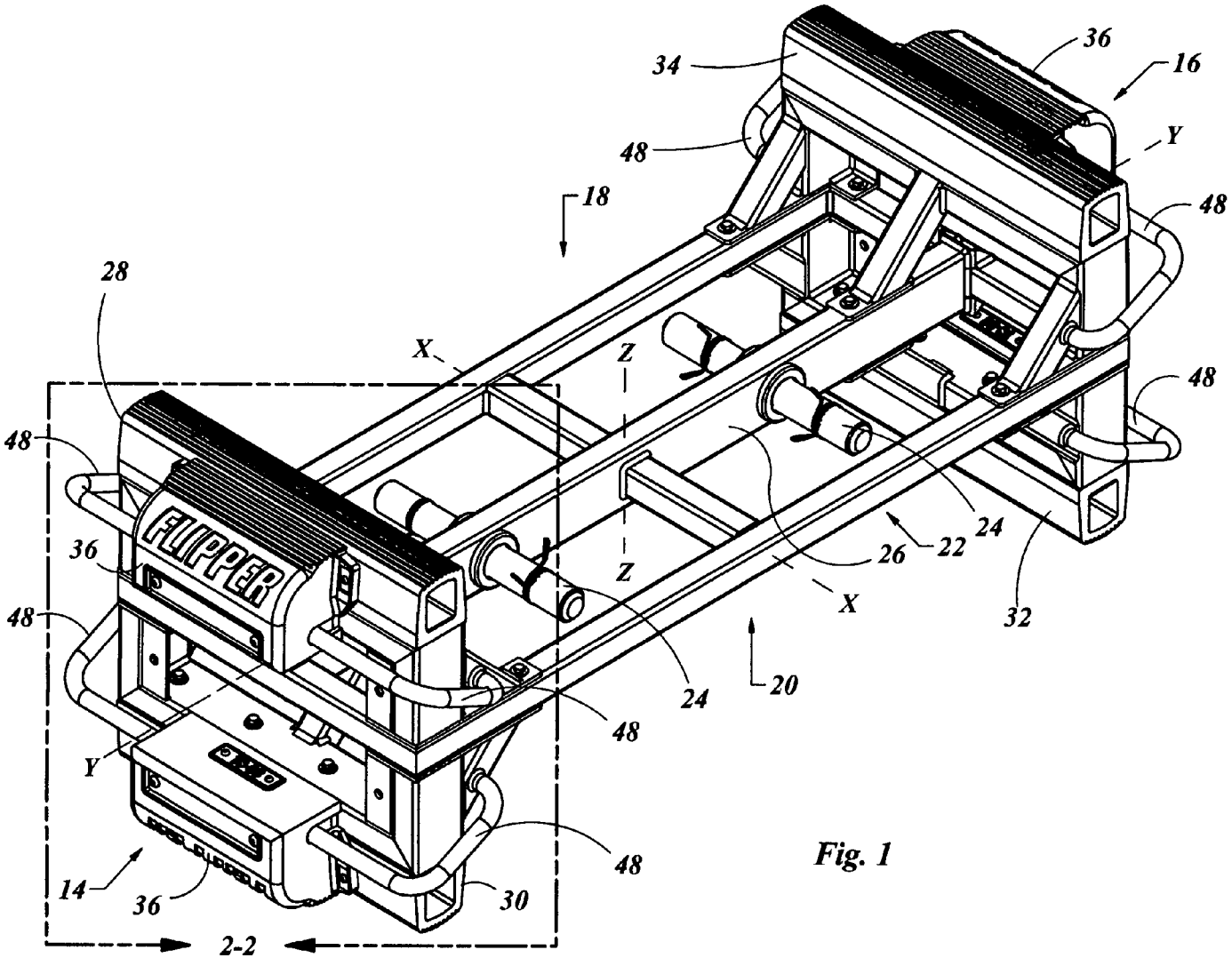
FIG. 1 is an isometric view of an exercise device enabling functional exercise with a varied resistance, in accordance with the present invention.
Figure 2:
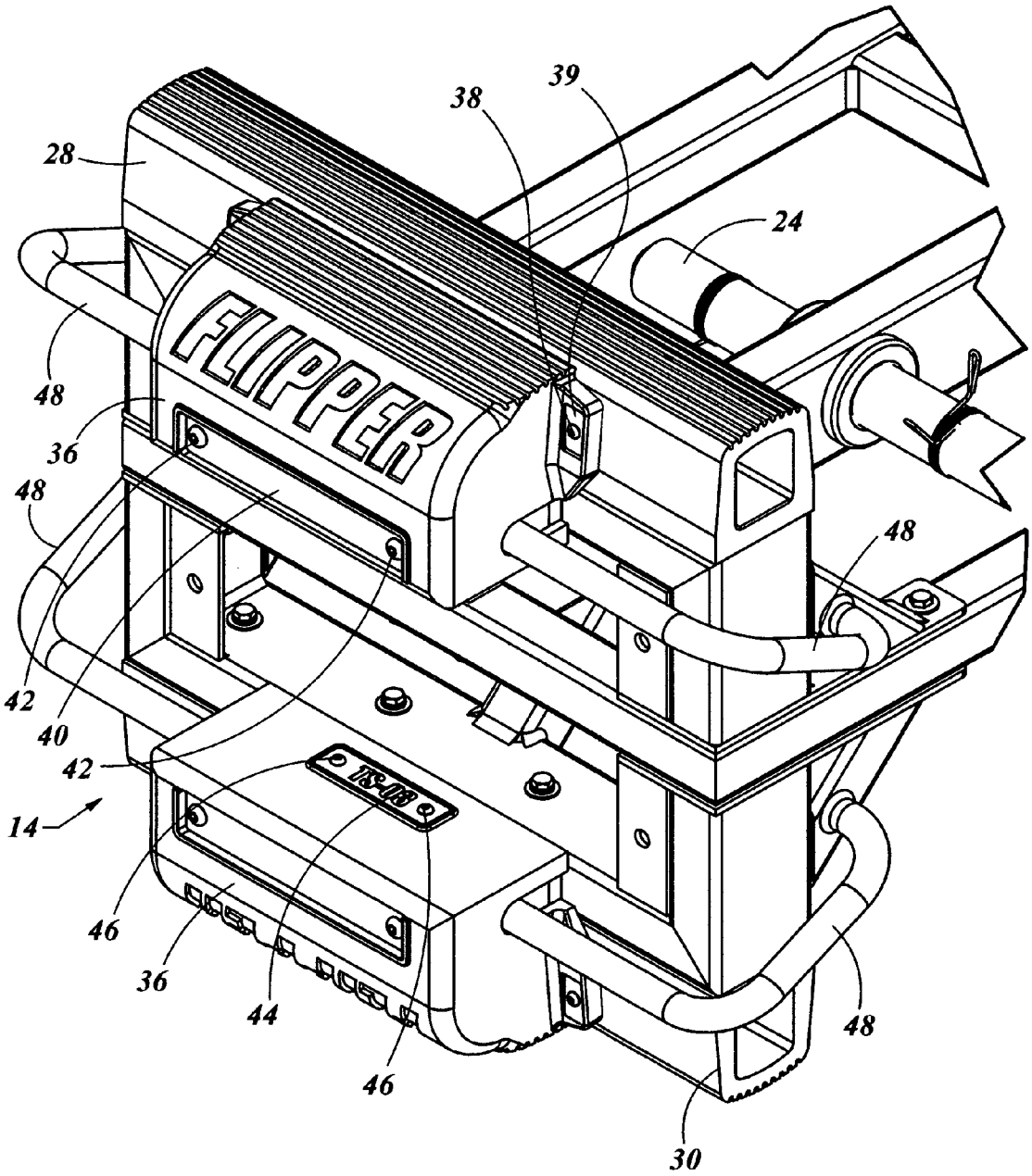
FIG. 2 is a detailed partial view of a first end of the device of FIG. 1, shown along line 2-2.

With reference to the illustrative drawings, and particularly to FIGS. 1 and 2, there is shown a functional exercise device 12. The device may include a first end 14 and a second end 16. The device may also include a top portion 18 and a bottom portion 20. In this embodiment the device is symmetrical about each of the axes x-x, y-y and z-z. Therefore, plane x-z would bisect the device 12 between the first end 14 and the second end 16. Plane x-y would bisect the device 12 between the top portion 18 and the bottom portion 20. Plane y-z would bisect a left and right half of the device 12. Here the centroid, or the dimensional center of the device 12, is the intersection of all three axes (x-x, y-y and z-z), as well as planes x-y, x-z and y-z, which are understood to be orthogonal to one another. It is not critical that the device 12 be symmetrical about the centroid, but it may be preferred. This will become more evident as the use of the device 12 is disclosed in more detail.

The device 12 may include a base frame 22 which may be substantially longitudinal in shape. The base frame 22 may extend from the first end 14 to the second end 16 of the device 12. The base frame 22 may support one or more pins 24 which may be coupled to the base frame 22, preferably as illustrated here, substantially centered on the base frame 22 in the x-y plane. In the preferred embodiment, as shown here, there are two pins 24 on each side of a center beam 26. The pins 24 may be located substantially equal distance from the x-z plane, which may bisect the device 12 equally between the first end 14 and the second end 16. The pins 24 may be adapted to receive one or more weight plates. Adding or removing weight plates enables the total weight of the device 12 to be altered.

In this embodiment, the structure and features of the first end 14 are the same as that of the second end 16. As such, the description and detail of the first end 14 may also apply to that of the second end 16. A first bumper 28 may be coupled to the frame 22 on the top portion of the first end 14 and a second bumper 30 may be coupled to the frame 22 on the bottom portion of the first end 14. In this embodiment, the device 12 is symmetrical about all three planes, therefore the top portion may be identical to the bottom portion. This symmetrical arrangement may allow the device 12 to be flipped over about the x-x axis and still maintain substantially the same physical representation to a user. For example, in FIG. 1, the device 12 would be supported on the second bumper 30 and the third bumper 32 on the ground or other supporting surface. If flipped over, the device 12 may be supported on the first bumper 28 and the fourth bumper 34. Regardless of the orientation, the view from a user standing adjacent to the first end 14 or the second end 16 may be substantially the same.

Adjacent to the first bumper 28 may be a chest support 36. The chest support 36 may be coupled to the first bumper 28 by a screw 38 on either side of the chest support 36. A support plate 39 may be used to help distribute the load of the screw 38 over a larger area of the chest support 36. Alternatively, the chest support 36 may be made continuous with the first bumper 28 as one single molded part. The chest support 36 may be disassociated from the first bumper 28, but it may be desirable to add structural integrity to the first bumper 28 by the added support of the chest support 36, and also to the chest support 36 by way of the structure of the first bumper 28. In a similar manner, a chest support 36 may be provided adjacent to each of the other bumpers (30, 32 and 34).

To further assist in securing the chest supports 36, one or more additional plates may be used. In this embodiment, a front plate 40 may be received by a recess in the chest support 36 and secured to the frame by screws 42. In a similar manner, a bottom plate 44 may be used to capture a large portion of material of the chest support 36 and secure it to the frame provided under the chest support 36. As previously noted, screws 46 may be used to fasten the bottom plate 44 to the frame. This may be desirable as the chest support 36 may be constructed of a pliable material such as rubber or polyurethane. When high compressive loads are placed on the chest support 36 it may tend to deform and be pulled off of the frame during use. The support structure as shown and described may help keep the chest support 36 in the proper position.

A set of handles 48 may be provided wherein the handles are closer to the centroid of the device 12 as compared to a distal portion of the chest support 36. In doing so, if a user places their chest against the chest support 36, there may be a space between the user's torso and the handles 48. The user may grasp the handles 48 on the bottom portion 20 with their chest against the chest support 36 on the top portion 18. The space provided between the chest support 36 and the handles 48 may reduce the likelihood of inadvertent contact between the shoulders or arms of the user and the handles 48. Without this spacing, the handles 48 on the top portion 18 may be in the way of the user. The handles 48 are necessary, as when the device 12 is flipped over, the top portion 18 then becomes the bottom portion 20. By positioning the handles 48 more toward the centroid of the device 12, compared to the outermost portion of the chest support 36, the potential is reduced for interference between the arm or shoulder of the user and the unused handles 48 on the upper portion 18.

Figure 3:
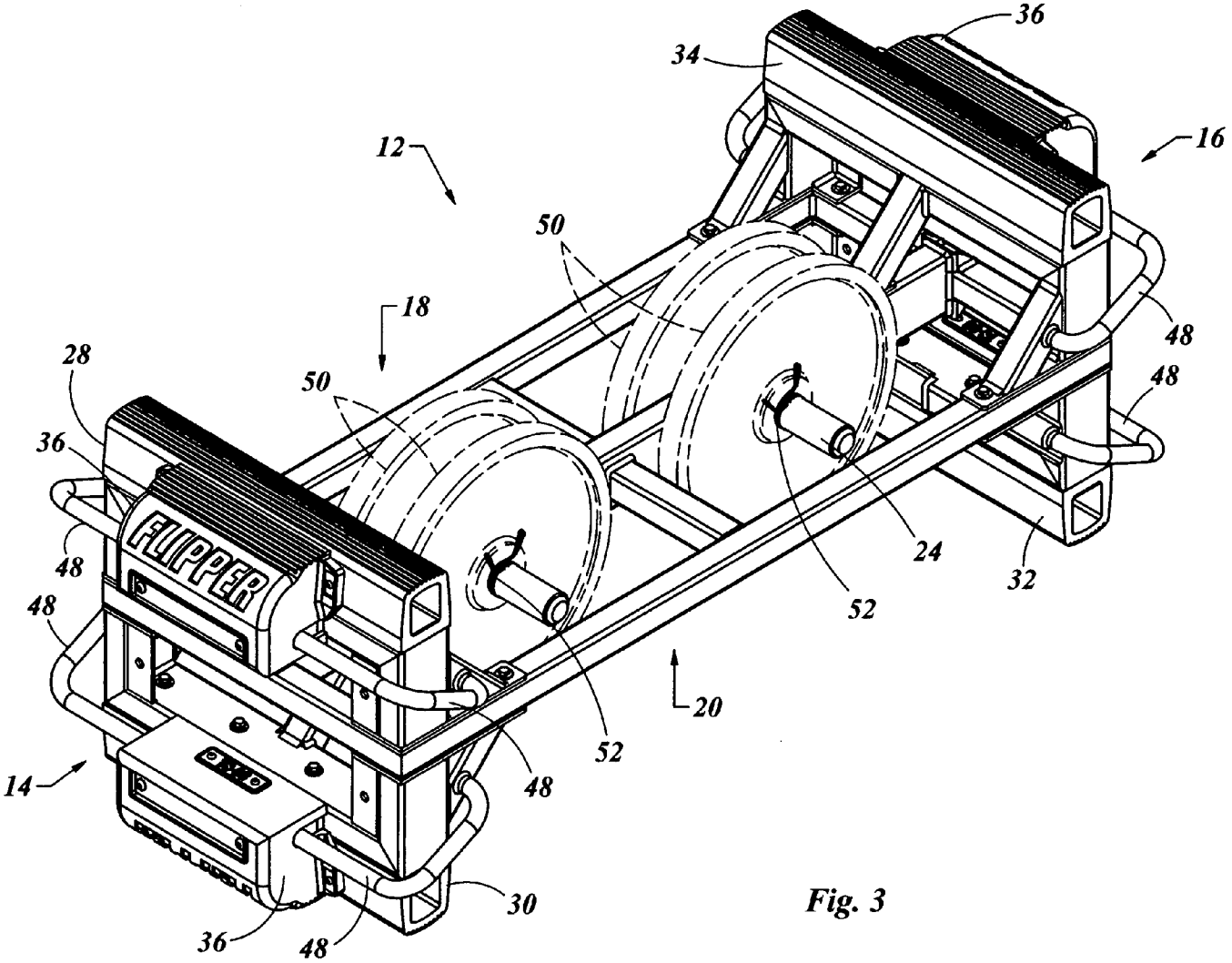
FIG. 3 is an isometric view of the device of FIG. 1, shone with weight plates for added resistance.

With reference to FIG. 3, the device is shown with weight plates 50 added to the pins 24. A spring clip 52 may be used as a collar to secure the weight plates 50 in place on the pins 24. A collar such as the spring clips 52 is not critical to the function of the device 12, but it is desirable for safety so the weight plates 50 do not become displaced from the pins 24 during use.

Figure 4:
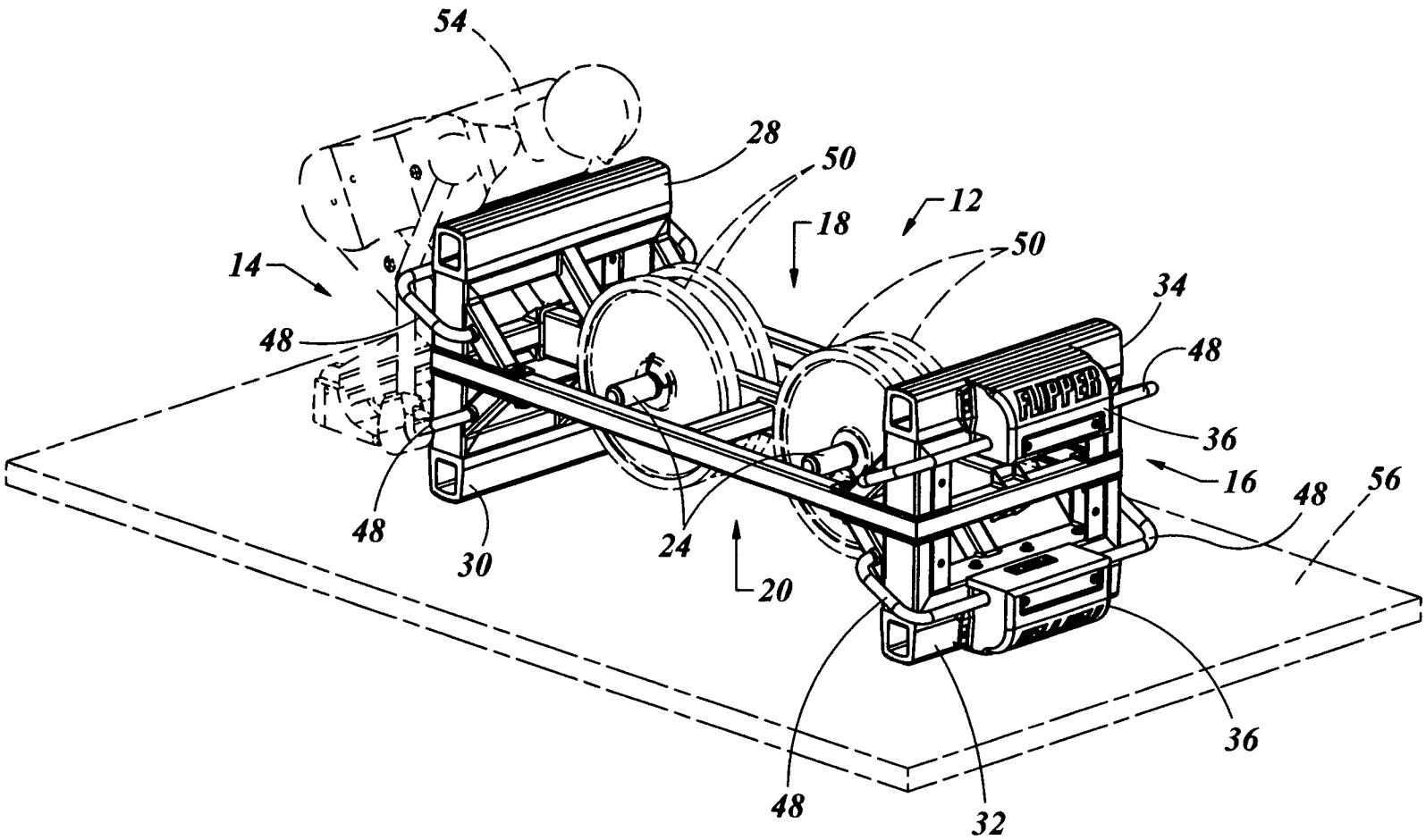
FIG. 4 is an isometric view of the exercise device of FIG. 3 in a starting position as it may be used with a user beginning to lift the device.
Figure 5:
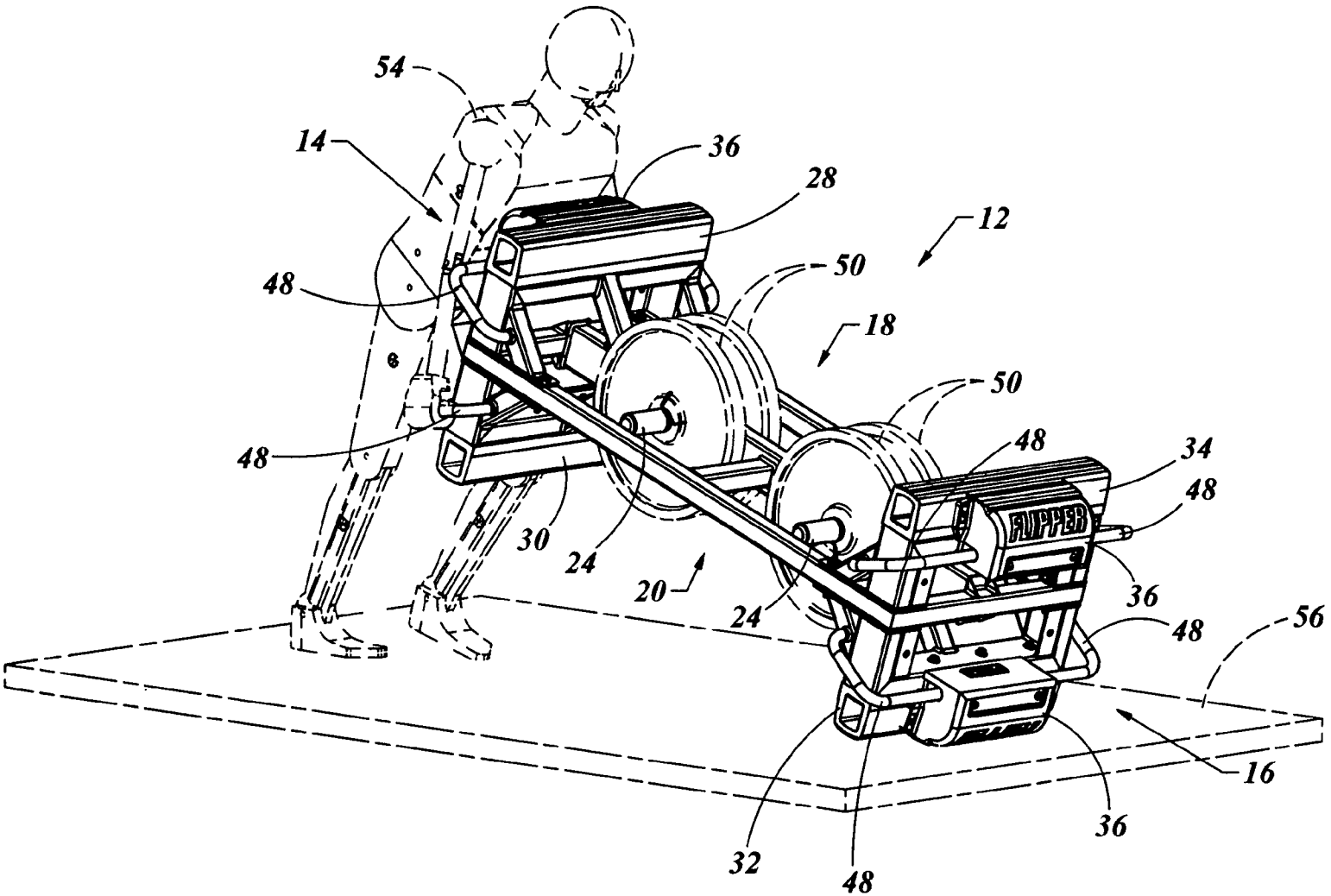
FIG. 5 is an isometric view of the exercise device of FIG. 3 during the lift prior to the second pull phase of the lift of the device by a user.
Figure 6:
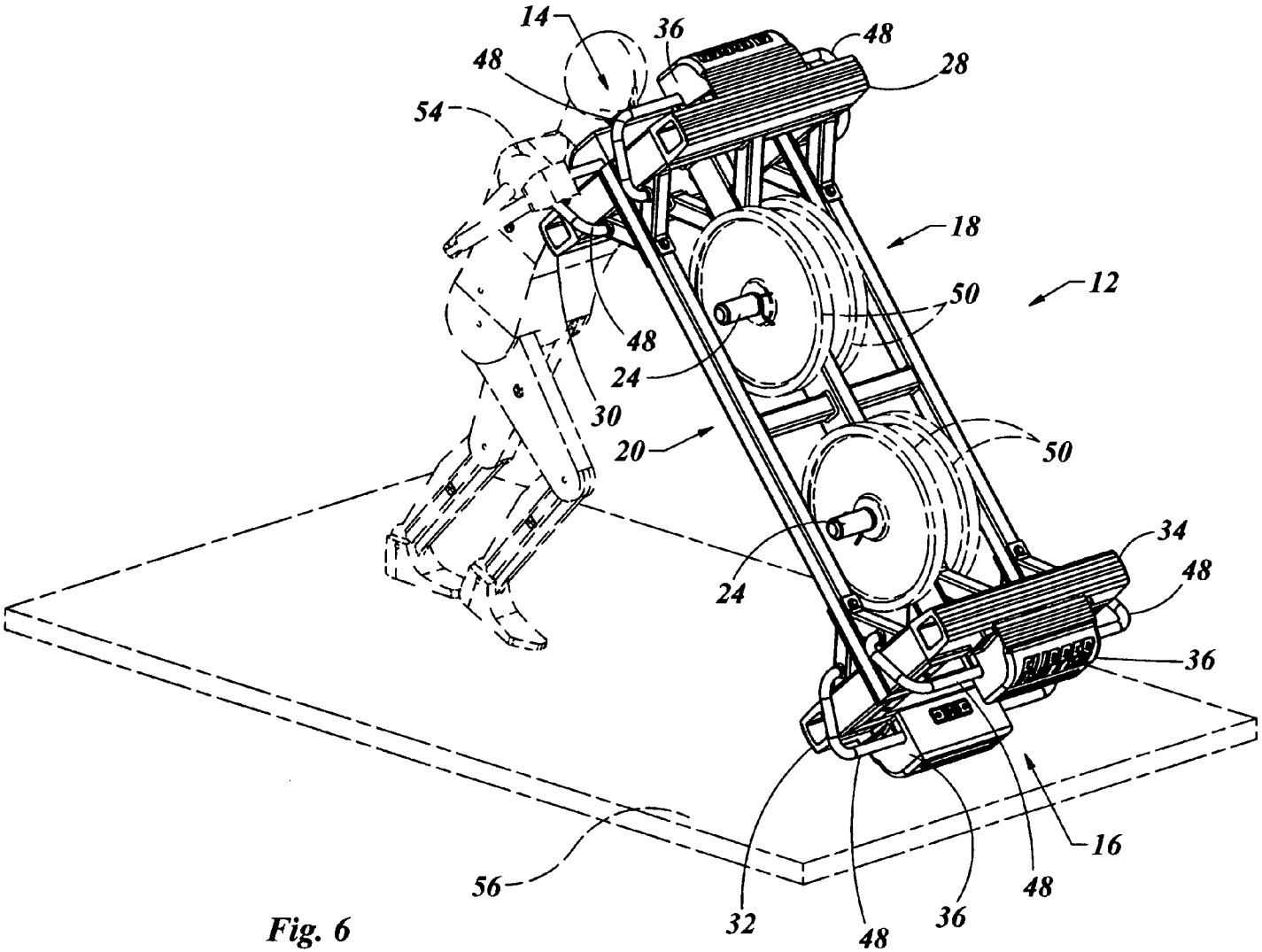
FIG. 6 is an isometric view of the exercise device of FIG. 3 during the lift transitioning from the press phase to the throw phase of the lift of the device by a user.

With reference to FIGS. 4 through 6, a use of the device 12 is shown. In FIG. 4 a user 54 is provided on the first end 14. The user 54 is being shown to grasp the handles 48 on the bottom portion 20 of the device 12. The chest support 36 on the upper portion 18 of the first end 14 of the device 12 may position the upper body of the user 54 such that the arms and shoulders of the user 54 may be positioned away from the handles 48 on the upper portion 18 of the first end 14 of the device 12. This spacing reduces the potential of the arms of the user 54 to contact the handles 48 on the upper portion 18 of the device 12 during the lift. Prior to the lift, the device 12 is supported by the second bumper 30 and the third bumper 32 on a supportive surface 56, such as the ground or floor. From this position, the user 54 extends their hips, knees and ankles to begin to lift the first end 14 of the device 12 off the supportive surface 56, while the bottom portion 20 of the second end 16 of the device 12 remains in contact with the supportive surface 56. This initial movement of the device 12 may be referred to as the "first pull".

As illustrated in FIG. 5, the user 54 continues to lift the first end 14 of the device 12 higher off the supportive surface 56. When the user 54 lifts the bottom portion 20 of the first end 14 of the device 12 to approximately knee height, the user 54 may step toward the device 12 while rapidly extending the hips, knees and ankles and driving the shoulders up and slightly back. This rapid movement drives the first end 14 of the device 12 up so that the bottom portion 20 of the first end 14 of the device 12 may move up toward the chest of the user 54. This rapid movement of the device 12 toward the chest of the user 54 may be referred to as the "second pull".

In FIG. 6, the user 54 may continue to step toward the device 12 as the first end 14 continues to be elevated by the user 54. At this point the user 54 may rotate their hand grip from a pull grip (wrists toward the body) to a push grip (wrists facing away from the body). This may be referred to as the "transition phase". Immediately following the transition phase, the user 54 may begin to extend the elbows and move the upper arms forward to press the first end 14 of the device 12 off their chest. This may be done while continuing to move toward the second end 16 of the device 12. As the user 54 nears full extension of the arms and anterior rotation of the shoulder, the user may continue to step toward the second end 16 of the device 12, which has remained on the supportive surface 56. With one final explosive extension of the legs, arms and slight flexion of the trunk, the user 54 may throw the first end 14 of the device 12 over the second end 16 of the device 12. The contact of the device 12 with the supportive surface 56 will transition from the bottom portion 20 to the second end 16 of the device as it approaches a vertical orientation. The device 12 may continue to rotate until supported on the supportive surface 56 by the first bumper 28 and the fourth bumper 34, thereby being flipped by the user 54. This final phase may be referred to as the "press phase" of the lift. The user 54 may approach the device 12, now inverted, and repeat the process.

The weight plates 50 may be added to one or both of the pins 24. By loading both pins 24 equally, the center of mass of the device 12 may remain at the centroid or dimensional center of the device 12. This means the first complete lift as previously described would be equal in difficulty and work performed as a subsequent second lift, flipping the device 12 in the same direction. By loading one pin 24 different than the other pin 24, the center of mass of the device 12 may not be located at the centroid of the device 12. This would enable the user 54 to do more work during a flip of the device 12 when the center of mass is closer to the user 54, compared to less work when performing a flip of the device 12 when the center of gravity is farther away from the user 54. This enables varied training where a user 54 may do a light-heavy-light-heavy series of lifts without stopping to change weights. Also, two users 54 of different strength potentials may be paired to train together. Lifting in sequence, both users 54 may lift to their physical potentials by doing alternating lifts with varied loading on the pins 24. This may be used to build teamwork between athletes of different physical abilities that must work together during their athletic competition.

Figure 7:
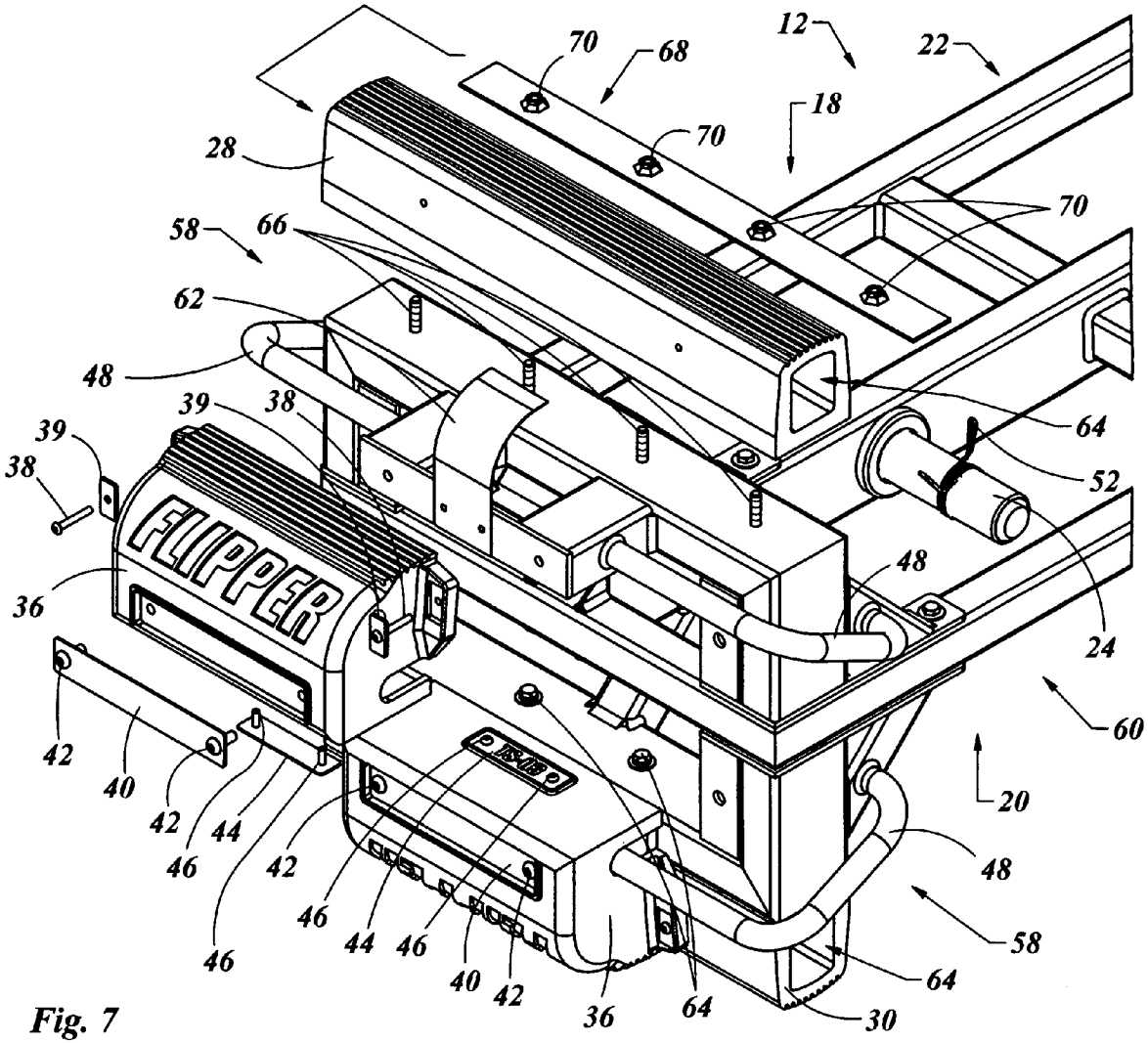
FIG. 7 is a partially disassembled view of the first end of the exercise device of FIG. 1.

The internal structure of a preferred embodiment is shown in FIG. 7. The base frame 22 may be joined on each end by an end frame 58. The end frame 58 may be identical on the top portion 18 and the bottom portion 20 of the device 12 and mounted to the base frame 22 by fastening one end frame 58 to the other end frame 58 with the base frame 22 in between. End frames 58 may summarily be mounted to the base frame 22 on the second end 16. The combination of the end frames 58 and the base frame 22 may comprise a frame 60.

The handles 48 may be coupled to the end frame 58. The end frame 58 may also support a leaf spring 62. The leaf spring 62 may be positioned under the chest support 36 to offer additional resistance to deformation of the chest support 36 under the load of the device 12. The chest support 36 may be produced of a pliable material, and therefore have elastic properties. It may also be desirable to increase the elastic strength of the chest support 36, especially under heavy loads while flipping. The leaf spring 62 may offer this additional support.

The first bumper 28 may include a hollow center 64. This hollow center 64 may increase the ability of the first bumper 28 to deform slightly upon impact with the ground while being flipped. This deformation may result in a dissipation of energy to reduce the impulse load on the frame 60 and the ground on which the first bumper 28 will impact. By doing so, the first bumper 28 may act as a resilient spring to increase the time over which the impact takes place, thus reducing the peak force of the impulse. This feature may also be the same for the other bumpers (30, 32 and 34).

This hollow center 64 may also be used to assist mounting of the first bumper 28 and the other bumpers (30, 32 and 34) to the end frames 58. The first bumper 28 may be mounted to the end frame 58 by way of bumper bolts 66. The bumper bolts 66 may extend through the end frame 58 and then through holes in the bottom of the first bumper 28. A bumper plate 68 may be provided which includes a nut 70 for each bumper bolt 66. The bumper plate 68 may be inserted into the hollow center 64 of the first bumper 28 such that the bumper bolts 66 may be received by the nuts 70 of the bumper plate 68. The bumper bolts 66 may be secured to the bumper plate 68, capturing the first bumper 28 between the bumper plate 68 and the end frame 58, thus securing the first bumper 28 to the frame 60.

Figure 10:
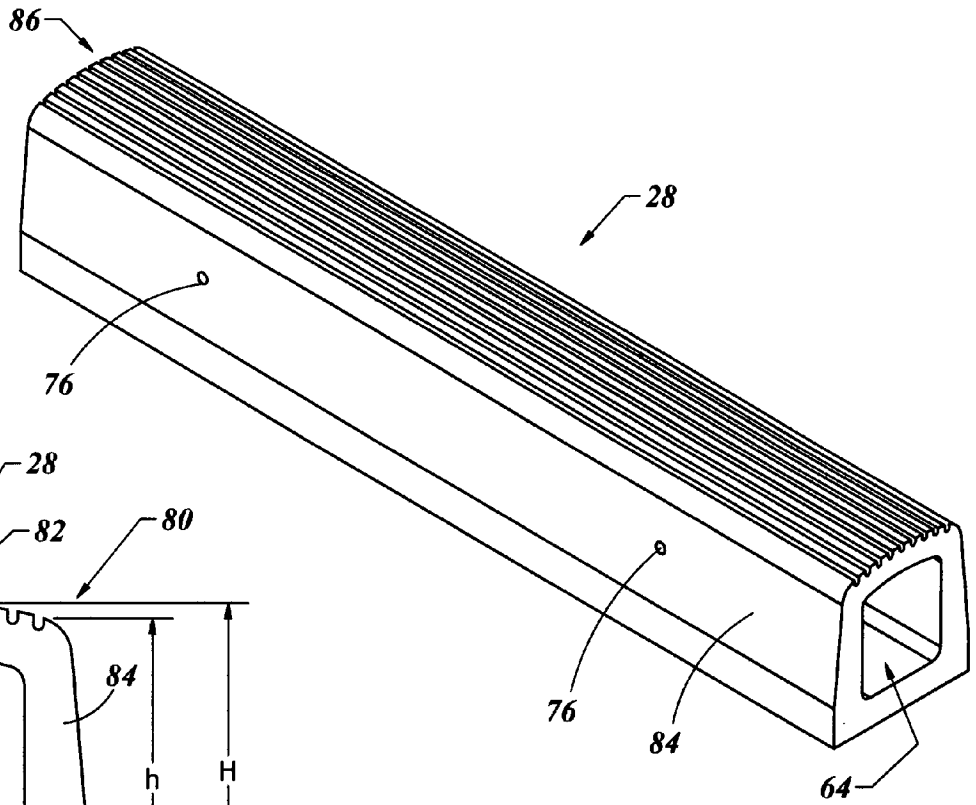
FIG. 10 is an isometric view of the bumper of FIG. 8.
Figure 9:
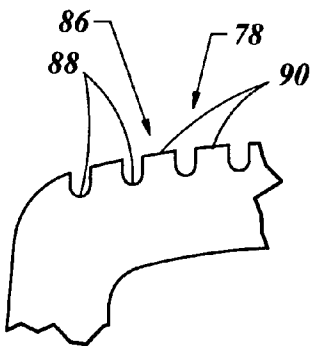
FIG. 9 is a detail view of a top portion of the bumper of FIG. 8 shown along line 9-9.
Figure 8:
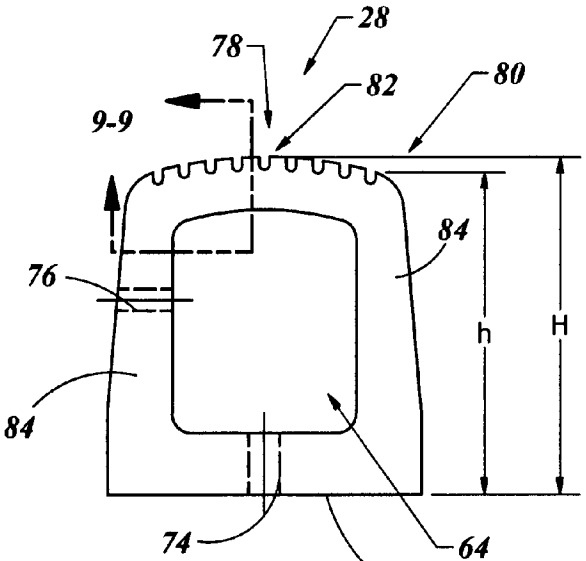
FIG. 8 is a front view of a bumper as it may be used on each of the four ends of the exercise device of FIG. 1.

A first bumper 28 is shown in an end view in FIG. 8, a detail of the top portion of the bumper 28 is shown in FIG. 9 and an isometric view of the entire bumper 28 is illustrated in FIG. 10. As previously noted, the second bumper 30, third bumper 32 and fourth bumper 34 may be similar in structure to the first bumper 28. For the purposes of this disclosure, the details of the first bumper as shown and described herein may also be applied to the other bumpers (30, 32 and 34). The first bumper 28 may include a substantially flat base 72. The base 72 may include one or more mounting holes 74 to receive the bumper bolts 66 to mount to the end frame 58 (FIG. 7). Side holes 76 may also be provided to assist in securing the first bumper 28 to the chest support 36 by way of the screws 42 (FIG. 7).

A primary function of the first bumper 28 may be to absorb the impact of the weight of the device 12 as it falls to the ground or floor at the conclusion of being flipped. It may then be desirable for the first bumper 28 to have elastic properties pursuant to the choice of material with which it is constructed as well as the design of the bumper 28. As previously noted, the first bumper 28 may include a hollow center 64. This hollow center 64 may allow for compression, or shortening of the dimension between a top section 78 relative to the base 72. Deflection in this height dimension "H" results in energy that is absorbed and dissipated as heat, as the elastic nature of the first bumper 28 is deformed and returns substantially to its original shape after impact. This energy that is dissipated through the first bumper 28 is not transferred to the frame 60, thereby reducing the stress on the more rigidly constructed frame 60.

Another unique design feature of the first bumper 28 may be an arcuate convex shape of the top section 78. The outside edges 80 of the top section 78 may be closer to the base 72 as compared to the center section 82 of the top section 78. This is graphically illustrated in that the height dimension "H" may be greater than "h". This shape of the top section 78 may have more than one benefit, as opposed to a concave or flat top section. First, the gradual transition of material contact with a flat surface, such as the ground upon impact, further increases the time over which the impact takes place. This increase in time, decreases the peak forces of the impulse of the collision with the ground, thus decreasing the stress on the frame 60. A second advantage may be an increased ability to displace air at the time of impact with the ground. This may reduce the shockwave amplitude, thus decreasing the noise as the first bumper 28 hits the ground.

The side walls 84 of the first bumper 28 may offer the primary structural support to substantially maintain the height dimension "H". The side walls 84 may be slightly wider near the base 72, as compared to nearer to the top section 78. This is not considered critical to the novelty of the invention but is considered an element in the optimization of the functional design of the first bumper 28.

Another added design element that may offer more than one functional feature is the tread 86 incorporated into the top section 78 of the first bumper 28. The tread 86 may include a plurality of grooves 88 and ridges 90. The combination of grooves 88 and ridges 90 may also offer a decreased section of material upon initial impact of the first bumper 28 with the ground. This may add to the cushioning effect of the first bumper 28 upon initial impact between the ground and the first bumper 28. Secondly, the grooves 88 may allow for air to be channeled out to the sides of the first bumper 28 as it strikes the ground. This may also help reduce noise upon impact. A third advantage may be an increased resistance to slide or slip. During the initial stage of the first pull phase of the lift, there may be a good deal of horizontal force applied to the device 12. If the device 12 slides away from the lifter at that time, the lifter may lose their balance and drop the device 12. The placement of the longitudinal tread 86 in the top section 78 of the first bumper 28 may help grip the ground or floor, relying not just on the friction between the surfaces, but the sheer force of the material of the first bumper 28 as the tread 86 may interact with an uneven surface of the floor or ground. This may help stabilize the device 12 during the lift.

Figure 11:
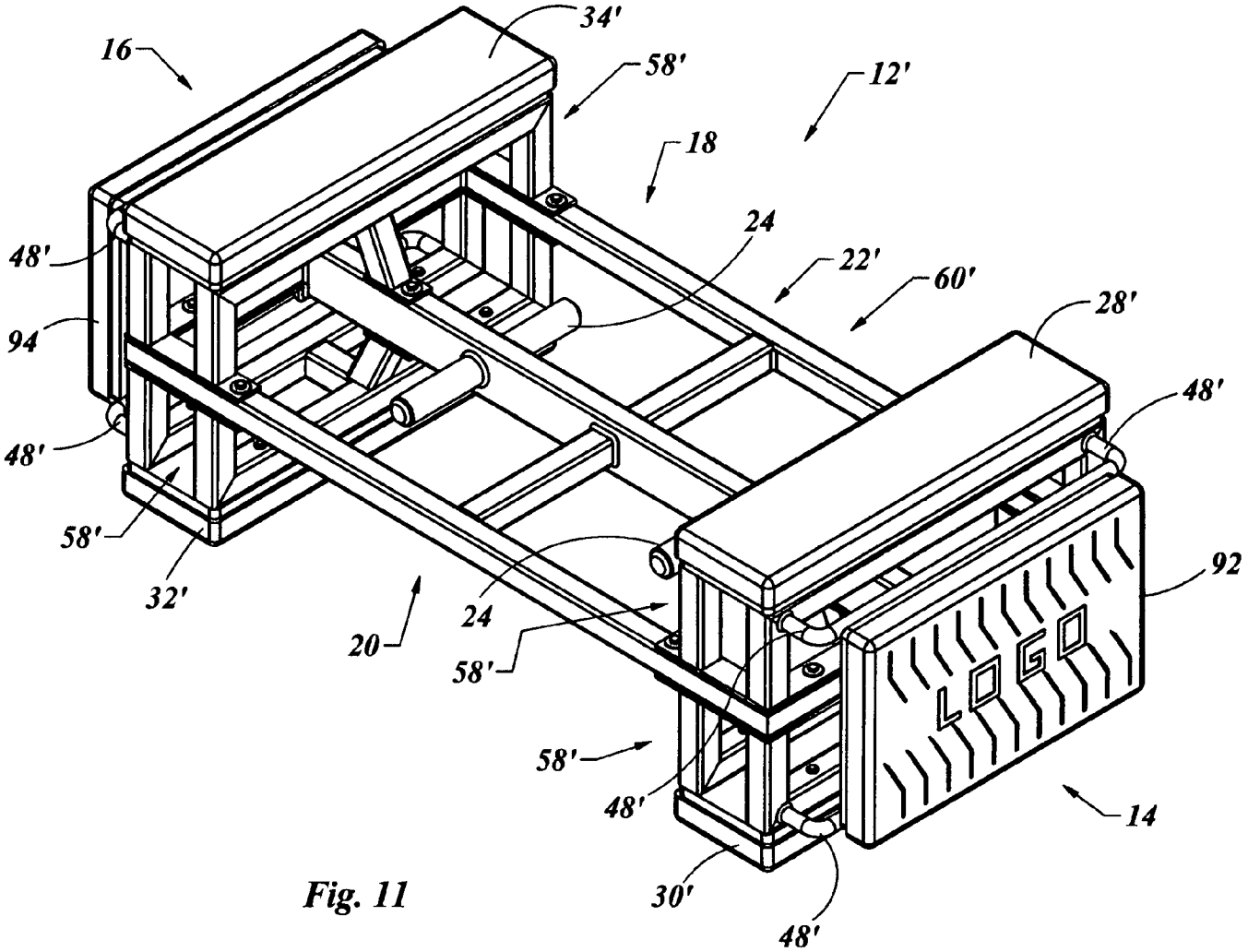
FIG. 11 is an isometric view of an alternative embodiment of the exercise device of FIG. 1.

An alternative to the preferred embodiment is shown in FIG. 11. The base frame 22' may include an end frame 58' on the top portion 18 and the bottom portion 20 of the first end 14 and the second end 16 of the device 12'. The base frame 22' may include two pins 24, which may be adapted to receive weight plates, as previously disclosed. The end frames 58' may each support a handle 48'. A first bumper 28' may be supported on the end frame 58' on the top portion 18 of the first end 14 of the device 12'. In a similar manner, a second bumper 30' may be positioned on the bottom portion 20 of the first end 14 of the device 12'. A third bumper 32' and a fourth bumper 34' may be on the bottom portion 20 and top portion 18 respectively of the second end 16 of the device 12'. In this embodiment, a first end pad 92 may act as a chest support for a lifter on the first end 14 of the device 12' and a second end pad 94 may function in a similar manner for a lifter on the second end 16 of the device 12'. In that the end pads 92 and 94 may be centered about two axes of the frame 60', the end pads 92 and 94 may function equally well regardless of the orientation of the upper portion 18 or the bottom portion 20 relative to the lifter.

In this embodiment, the details of the first bumper 28' and the other bumpers (30', 32' and 34') as before, may be similar regardless of the location on the device 12'. The first bumper 28' may include a hollow center, treads and a curved top section, as previously disclosed. Alternatively, the first bumper 28' may be a foam pad covered with upholstery. In this embodiment, the air trapped in the covered first bumper 28' acts as a damper to slow the deceleration of the device 12' upon impact with the ground. The air trapped in the foam is forced to escape through vents incorporated into the construction of the bumper 28'. When not under load, the foam acts as a spring to slowly expand and draw the air back into the first bumper 28', readying it for the next impact with the ground.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. An exercise device, comprising:

a substantially longitudinal base frame including a first end opposite to a second end and a first end frame including a top and a bottom opposite to a second end frame including a top and a bottom, wherein the first end frame extends vertically from the first end and the second end frame extends vertically from the second end;

a plurality of handles coupled to the base frame and adjacent to the first end and the second end of the base frame such that the base frame and the plurality of handles in combination is substantially symmetrical about three orthogonal planes intersecting at a geometric center of the base frame;

at least one pin coupled to the base frame between the first end and the second end, the at least one pin adapted to receive a weight plate; and a first bumper directly coupled to the top and a second bumper directly coupled to the bottom of the first end frame, another first bumper directly coupled to the top and another second bumper directly coupled to the bottom of the second end frame, whereby the device can be supported by two of the bumpers and flipped over to be supported by the other two bumpers.

2. The exercise device according to claim 1, further comprising at least one chest support coupled to the base frame and positioned adjacent to at least one of the first bumper, the second bumper, another first bumper and another second bumper.

3. The exercise device according to claim 2, wherein the at least one chest support is positioned such that a portion of the at least one chest support has a greater distance from the geometric center of the base frame compared to a distance of any portion of the base frame to the geometric center of the base frame.

4. The exercise device according to claim 2, wherein the at least one chest support is directly coupled to the at least one of the first bumper, the second bumper, another first bumper and another second bumper.

5. The exercise device according to claim 1, wherein the base frame is substantially symmetrical about the three orthogonal planes intersecting at the geometric center of the base frame.

6. The exercise device according to claim 1, wherein the at least one pin is positioned substantially along a longitudinal axis of the base frame.

7. The exercise device according to claim 1, wherein the at least one pin is comprised of a pair of pins, each positioned substantially along a longitudinal axis of the base frame and each pin positioned on opposing sides of a midpoint between the first end and the second end of the base frame.

8. The exercise device according to claim 1, further comprising a chest support coupled to the base frame, such that a portion of the chest support has a greater distance from the geometric center of the base frame compared to a distance from each of the plurality of handles to the geometric center of the base frame.

9. The exercise device according to claim 1, wherein each of the first bumper, second bumper, another first bumper and another second bumper is a substantially longitudinal hollow member.

10. The exercise device according to claim 1, wherein each of the first bumper, second bumper, another first bumper and another second bumper includes a plurality of treads on a side opposite to that coupled to the base frame.

11. functional exercise device, comprising:

a substantially longitudinal base frame with a first end opposite to the second end and a first end frame including a top and a bottom, opposite to a second end frame including a top and a bottom, wherein the first end frame extends vertically from the first end and the second end frame extends vertically from the second end;

a plurality of handles coupled to the base frame and adjacent to the first end and the second end of the base frame such that the base frame and the plurality of handles in combination is substantially symmetrical about three orthogonal planes intersecting at a geometric center of the base frame;

at least one pin coupled to the base frame between the first end and the second end, the at least one pin adapted to receive a weight plate; and a first bumper directly coupled to the top of the first end frame, a second bumper directly coupled to the top of the second end frame, a third bumper directly coupled to the bottom of the first end frame and a fourth bumper directly coupled to the bottom of the second end frame, whereby the exercise device can be supported on the first and second bumpers or flipped over to be supported on the third and fourth bumpers.

12. The functional exercise device according to claim 11, further comprising at least one chest support coupled to the base frame and positioned adjacent to at least one of the first bumper, second bumper, third bumper and fourth bumper.

13. The functional exercise device according to claim 12, wherein the at least one chest support is positioned such that a portion of the at least one chest support has a greater distance from the geometric center of the base frame compared to a distance of any portion of the base frame to the geometric center of the base frame.

14. The functional exercise device according to claim 12, wherein the at least one chest support is directly coupled to the at least one of the first bumper, second bumper, third bumper and fourth bumper.

15. The functional exercise device according to claim 11, wherein the base frame is substantially symmetrical about the three orthogonal planes intersecting at the geometric center of the base frame.

16. The functional exercise device according to claim 11, wherein the at least one pin is positioned substantially along a longitudinal axis of the base frame.

17. The functional exercise device according to claim 11, wherein the at least one pin is further comprised of a pair of pins, each positioned substantially midway along a longitudinal axis of the base frame and each pin positioned on opposing sides of a midpoint between the first end and the second end of the base frame.

18. The functional exercise device according to claim 11, further comprising at least one chest support coupled to the base frame such that a portion of the at least one chest support has a greater distance from the geometric center of the base frame compared to a distance from each of the plurality of handles to the geometric center of the base frame.

19. The functional exercise device according to claim 11, wherein each of the first bumper, second bumper, third bumper and fourth bumper is a substantially longitudinal hollow member.

20. The functional exercise device according to claim 11, wherein each of the first bumper, second bumper, third bumper, and fourth bumper includes a plurality of treads on a side opposite to that coupled to the base frame.

21. A method of exercising using a device including a substantially longitudinal base frame with a first end opposite to a second end and a first end frame including a top and a bottom opposite to a second end frame including a top and a bottom, wherein the first end frame extends vertically from the first end and the second end frame extends vertically from the second end; handles coupled to the base frame and adjacent to the first end and the second end of the base frame such that the base frame and the handles in combination is substantially symmetrical about three orthogonal planes intersecting at a geometric center of the base frame; a pin coupled to the base frame between the first end and the second end, the pin adapted to receive a weight plate; a first bumper directly coupled to the top and a second bumper directly coupled to the bottom of the first end frame, another first bumper directly coupled to the top and another second bumper directly coupled to the bottom of the second end frame, the method of exercise including the steps of:

a) grasping the handles at one of the first or the second end of the base frame, b) lifting the device while the other of the first or the second end of the base frame is supported on the ground by the second bumper or another second bumper at the bottom of the first or the second end frames, respectively, and flipping the device over;

c) changing the weight plates on the pin;

d) lifting the device again; and e) repeating steps a-d.

22. The method of exercising according to claim 21, wherein the step of lifting the device includes the steps of:

lifting one of the first or the second end of the base frame to an above a knee position of a user;

lifting the one of the first or the second end of the base frame from the above the knee position toward a chest of the user;

resetting arms of the user from a pull grip to a push grip; and extending the arms and legs of the user to cause the device to be flipped over away from the user.

* * * * *